United States Patent [19]

List et al.

[11] 4,452,186

[45] Jun. 5, 1984

[54] VALVE CONTROL FOR INTERNAL COMBUSTION ENGINES

[75] Inventors: Rainer List, Renningen; Klaus Schellmann, Hemmingen; Heinz Schulze, Stuttgart, all of Fed. Rep. of Germany

[73] Assignee: Dr. Ing. h.c.F. Porsche AG, Fed. Rep. of Germany

[21] Appl. No.: 232,828

[22] Filed: Feb. 9, 1981

[30] Foreign Application Priority Data

Feb. 7, 1980 [DE] Fed. Rep. of Germany ..... 3004396

[51] Int. Cl.[3] ..... F01L 1/34

[52] U.S. Cl. ..... 123/90.16; 123/90.55

[58] Field of Search ..... 123/90.16, 90.55, 90.56, 123/90.57, 90.58, 90.59

[56] References Cited

U.S. PATENT DOCUMENTS

| | | | |
|---|---|---|---|
| 2,652,038 | 9/1953 | Winkler | 123/90.55 |
| 2,833,257 | 5/1958 | Lengnick | 123/90.57 |
| 3,786,792 | 1/1974 | Pelizzoni et al. | 123/90.16 |
| 4,112,884 | 9/1978 | Tominaga | 123/90.55 |
| 4,254,749 | 3/1981 | Krieg et al. | 123/90.55 |
| 4,347,812 | 9/1982 | Kosuda et al. | 123/90.55 |

*Primary Examiner*—Craig R. Feinberg
*Assistant Examiner*—W. R. Wolfe
*Attorney, Agent, or Firm*—Craig & Burns

[57] ABSTRACT

A valve control for internal combustion engines comprising a hydraulic arrangement between a cam shaft and a cylinder head valve, the hydraulic arrangement including a piston system having at least a power piston cooperable with the cam shaft and an activating piston, a housing within which at least the actuating piston of the piston assembly is contained and a damping means for controlling valve seating operation. The hydraulic arrangement forms part of a means for varying the stroke and opening time of the cylinder head valve in response to at least one operating parameter of the internal combustion engine, and the means for varying the stroke and opening time also includes a throttle element for influencing the piston system, the throttle element being controlled by the noted at least one operating parameter of the internal combustion engine. In accordance with one embodiment, the piston system comprises at least three pistons, at least a drive piston being provided in addition to the power and actuating pistons, the drive piston having the piston valve therein.

29 Claims, 20 Drawing Figures

VALVE CONTROL FOR INTERNAL COMBUSTION ENGINES

BACKGROUND AND SUMMARY OF THE INVENTION

The invention relates to a valve control for internal combustion engines, comprising a hydraulic arrangement located between the camshaft and the valve. The arrangement varying, by way of a piston system mounted in a housing, the valve stroke and opening time in response to different operating conditions of the internal combustion engine.

The power, torque, exhaust gas emission, and fuel consumption of an internal combustion engine can be optimized by varying the stroke and control time of a valve control. Under full load, maximum stroke and maximum opening time are necessary for this purpose, while in the partial load range these two valve control quantities must be reduced.

In a known valve control (periodical Road and Track, April 1977, page 122) an axially movable camshaft carrying a sloping cam cooperates with a valve. The valve stroke and opening time vary in dependence of the cam axial position. The variation is determined in response to the rpm by a centrifugal governor. This structure entails the disadvantage that highly abrasive friction forces develop in the variation determining the shifting process between the camshaft and the shaft end penetrating therein. In addition the elements of this shifting arrangement provide for mechanical complication resulting in high costs.

To avoid these problems a hydraulic arrangement comprising a piston system is arranged between the camshaft and the valve in a known valve control (German Offenlegungsschrift-No. 2,101,542). The stroke and control time variation occurs in response to the oil pressure in the internal combustion engine. It has been found disadvantageous in this case that the oil pressure increase and decrease over the rpm range is not constant, which interferes with exact variations. The oil viscosity and temperature also may cause irregularities.

Furthermore, especially in the engine partial load range, the valve always strikes hard on its seat since in this operating condition the valve leads the cam.

Therefore, an object of the present invention is to provide, between the camshaft and the valve of an internal combustion engine, a hydraulic arrangement designed to vary the valve stroke and control time, and adapted functionally and exactly to changing engine operating conditions. Provisions are made also to avoid the hard impact of the valve on its seat on closing, especially in the partial load range.

According to the present invention this object is achieved by a hydraulic arrangement interposed between the cam shaft and valve which has a piston system with at least a power piston and an actuating piston, the piston system being influenced by a throttle element that is controlled in response to one or more engine operation parameters. In one embodiment the piston system has at least three pistons, a drive piston being interposed between the power and actuation pistons, and in all cases a damping means is provided for controlling the valve seating operation.

The primary advantages derived from the invention result from the provision of a piston system comprising at least three pistons, the damping means, and the throttle element responsive to engine parameters determining the satisfactory operation of the hydraulic arrangement varying the valve stroke and opening time. The damping means provides for the deceleration of the valve and the damping of the end of the seating action, especially in the partial load range.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
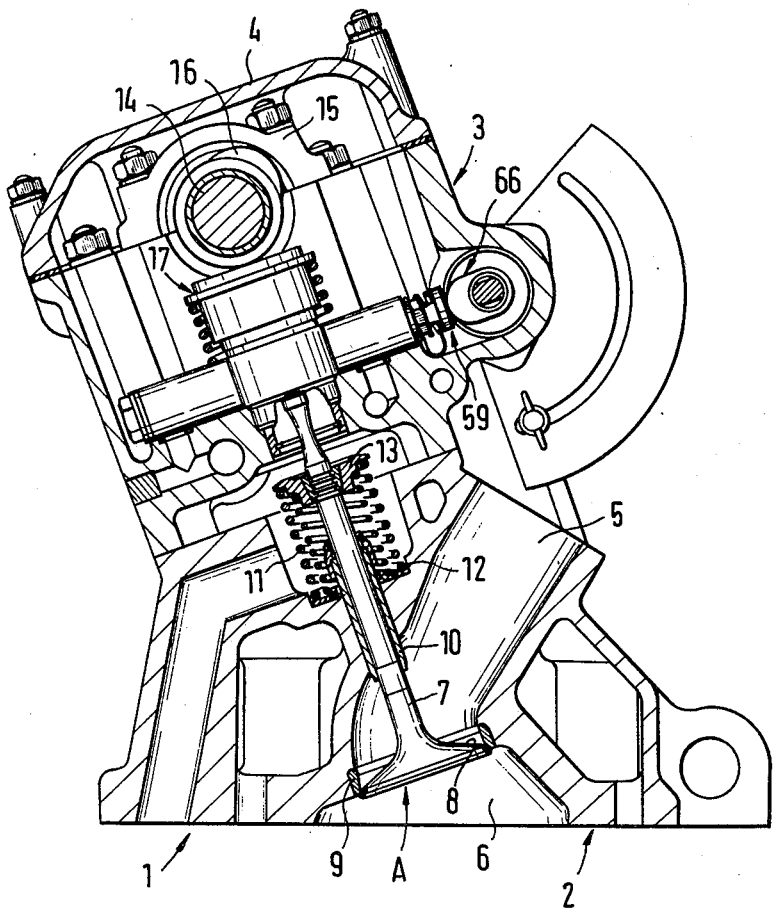
FIG. 1 is a cross section through the cylinder head of an internal combustion engine with a valve control and a hydraulic arrangement of the invention.

The cylinder head 2, camshaft housing 3, and cylinder cover 4 of an internal combustion engine 1 are represented in FIG. 1. Cylinder head 2 comprises an intake passage 5 and a combustion chamber 6 between which a valve 7 operates. The disk 8 of valve 7 is in contact with a seat 9 and axially movable in a sleeve 10. A spring 11 abutting against a wall 12 of cylinder head 2 and a spring disk 13 fixed to valve 7 retains valve 7 in the closed position A.

A camshaft 14 is mounted in a bearing 15 in camshaft housing 3. A cam 16 of camshaft 14 cooperates with valve 7 through a hydraulic arrangement 17.

Figure 2:
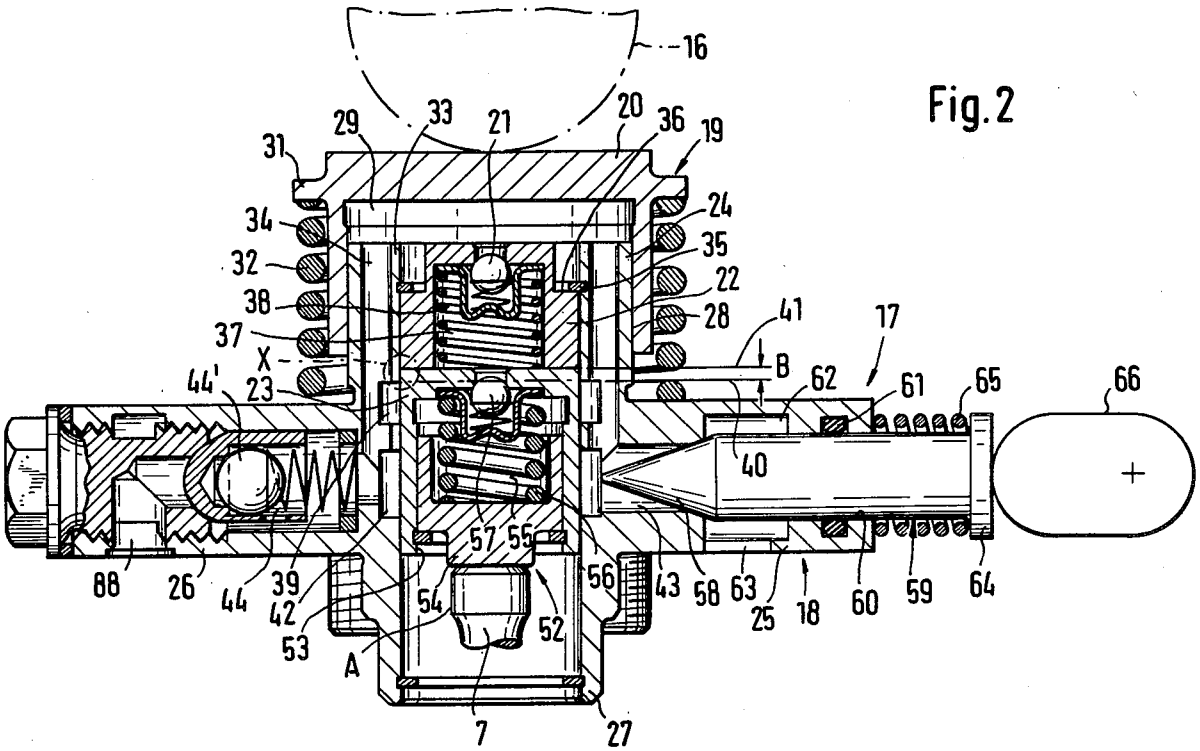
FIG. 2 is a section on a larger scale through the hydraulic arrangement of FIG. 1.

Hydraulic arrangement 17 comprises a housing 18 and a piston system 19 (FIG. 2). Piston system 19 consists of a power piston 20 cooperating with cam 16 of camshaft 14, a drive piston 22 provided with a piston valve 21, and an actuating piston 23 directly operating valve 7.

Housing 18 is in the form of a cross comprising four arms 24, 25, and 26, 27 intersecting at a right angle. Arm 24 is in the form of a cylindrical sleeve 28 whose external surfaces guide power piston 20. Cylindrical sleeve 28 and power piston 20 limit a pressure chamber 29.

A collar 31 is provided at the upper end 30 of power piston 20. Between collar 31 and the arms 25 and 26 or housing 18 there is a compression spring 32.

Housing 18 contains another cylindrical sleeve 33 whose diameter is smaller than that of outer cylindrical sleeve 28, and which is separated from the latter sleeve by a loop passage 34. Cylindrical sleeve 33 guides drive piston 23 whose surfaces are the same.

In the closed position A of valve 7 drive piston 22 is held in place on one side by actuating piston 23 and on the other side by a stop 35. A stepped shoulder 36 is provided on drive piston 22 for the purpose of engaging shoulder 36.

Drive piston 22 is provided with a boring 37 which contains a compression spring 38 abutting against actuating piston 23. Boring 37 also contains piston valve 21 which is in the form of a check valve.

Cylindrical sleeve 33 presents a recess 39 whose horizontal upper limit edge 40 is located under the horizontal surface 41 of actuating piston 23 in the inactive position A of the valve by a distance B. At least in the illustrated embodiment, however, the distance B is relatively short.

Another recess 42 in cylindrical sleeve 33 is connected to transverse borings 43 and 44 provided in the arms 24 and 25 of housing 18. A check valve 44' is provided in boring 44 to block flow in the direction opposite that of inflow. Transverse borings 43 and 44 and recesses 39 and 42 are connected to loop passage 34 and pressure chamber 29.

Figure 3:
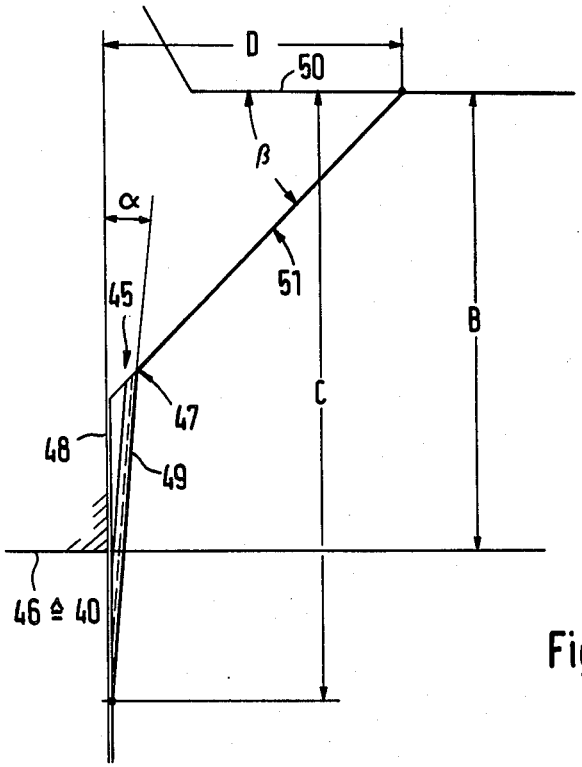
FIG. 3 represents on a larger scale a detail X of FIG. 2.

Actuating piston 23 controls the valve seating operation with a damping means 45 (FIG. 3 showing detail X of FIG. 2). Damping means 45 operates according to the displacement principle and consists of a control edge 46 coinciding with limit surface 40, and of a bevel edge system 47 provided at the upper end of actuating piston 23. Bevel edge system 47 comprises a first bevel edge 49 related to a vertical line 48 by an angle $\alpha$ and a second bevel edge 51 related to a horizontal line 50 by an angle $\beta$. First bevel edge 49 extends at an angle $\alpha$ of for example 1°–10°, and the second bevel edge at an angle $\beta$ of for example 20°–70°. The distances C and D at which bevel edges 49 and 51 begin are empirically determined.

In the embodiment of FIG. 2, an arrangement 52 for automatic valve play compensation is integrated in actuating piston 23. The arrangement 52 includes a piston 54 mounted in a recess 53 in actuating piston 23, a pressure chamber 55, a compression spring 56, and a piston check valve 57. Arrangement 52 is known per se and thus its operation need not be described.

Boring 43 in arm 25 is closed by the conical end 58 of a throttle element 59 movably mounted in a boring 60. A seal preventing pressure medium outflow is provided at 61. An annular space 62 extending around throttle element 59 presents an orifice 63.

The free outer end of throttle element 59 is provided with a collar 64, and a compression spring 65 engages the side of said collar 64 oriented toward housing 18. The opposite side of collar 64 cooperates with a setting cam 66. The setting cam 66 may be moved in response to engine operation parameters in various manners as can be seen with reference to FIGS. 4–7.

Figure 4:
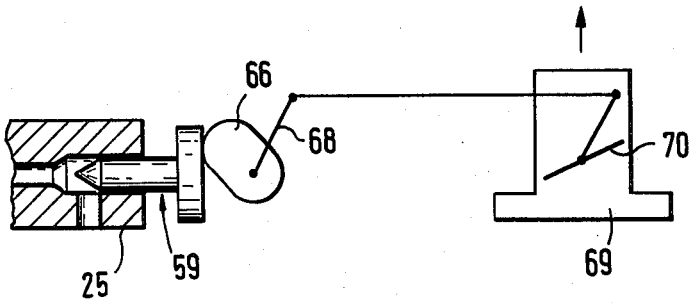
FIGS. 4–7 are schematic views of an actuating system for a throttling element of the invention.

As shown in FIG. 4, setting cam 66 may be moved by a linkage 68 driven by a choke 70 contained in a suction line 69.

Figure 5:
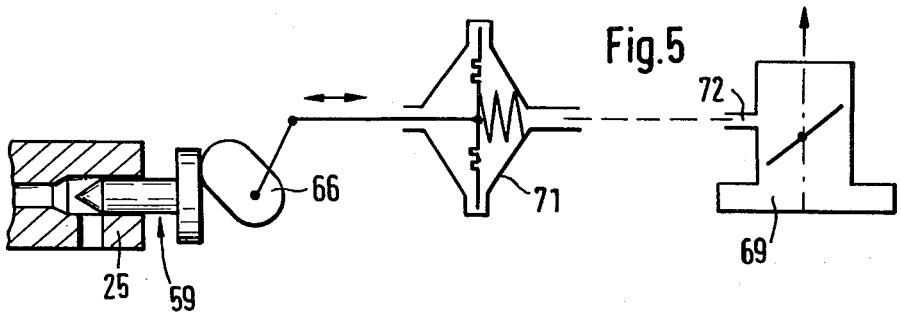

In FIG. 5, the drive of cam 66 is effected by a pressure responsive device 71 actuated by a vacuum transducer 72 contained in suction line 69. In these two embodiments (FIGS. 4 and 5) throttle element 59 is responsive to engine load.

Figure 6:
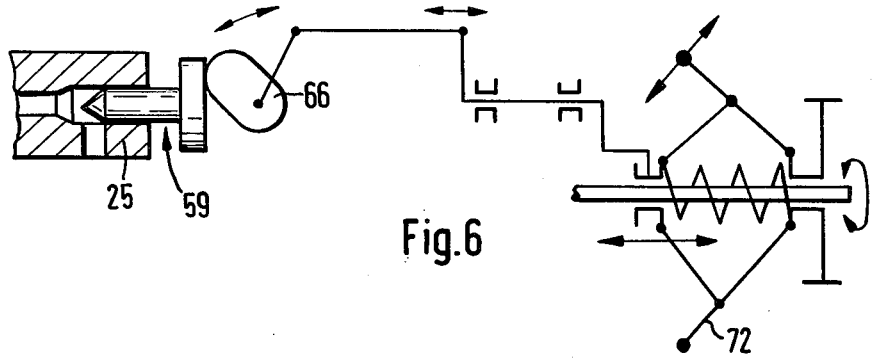

FIG. 6 represents an rpm responsive control. In this case setting cam 66, and therefore throttle element 59, is actuated by a centrifugal governor 72.

Figure 7:
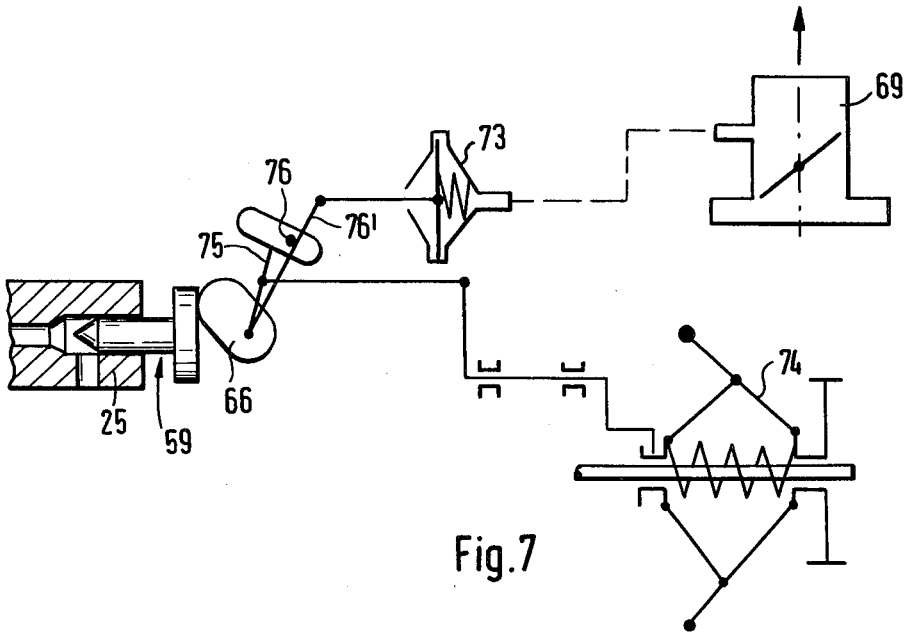

Finally, FIG. 7 represents an rpm and load responsive control comprising a pressure responsive device 73 and a centrifugal governor 74. In this embodiment, the control is effectuated by superposition, i.e. at low rpm and weak suction line vacuum, for example under acceleration, setting cam 66 is moved with rpm priority, or in other words the maximum shift possible as a result of vacuum in the suction line is limited by the distance of travel determined by the low rpm.

For this purpose, an actuating member 75 controlled by centrifugal governor 74 is provided with a stop 76 which limits an actuating member 76' connected to pressure responsive device 73. Relatively movable actuating members 75 and 76 are attached to setting cam 66.

On deceleration of the engine, throttle element 59 at least tends to be controlled in the reverse sequence, i.e. with load response priority.

Figure 8:
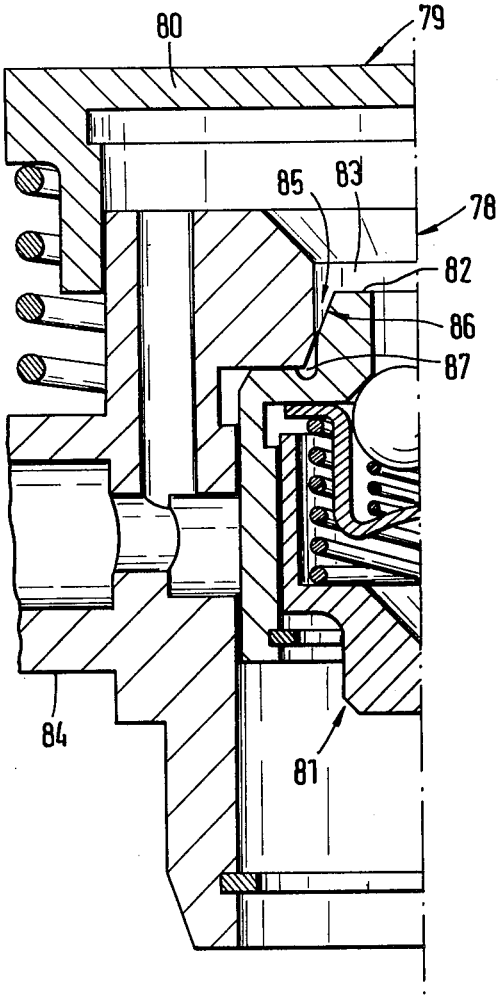
FIG. 8 represents another embodiment of the hydraulic arrangement of FIG. 1 on a larger scale.

FIG. 8 represents a hydraulic arrangement 78 including a power piston 80 and an actuating piston 81. A stepped extension 82 of actuating piston 81 penetrates a recess 83 in a housing 84. A damping means 85 operating according to the displacement principle to control the valve seating operation is provided between extension 82 and recess 83. Damping means 85 consists of a bevel edge system 86 located on the side of the actuating piston. It is possible also to provide a bevel edge system 87 on housing 84. The rest of the structure of hydraulic arrangement 78 is substantially identical to that of hydraulic arrangement 17.

Figure 9:
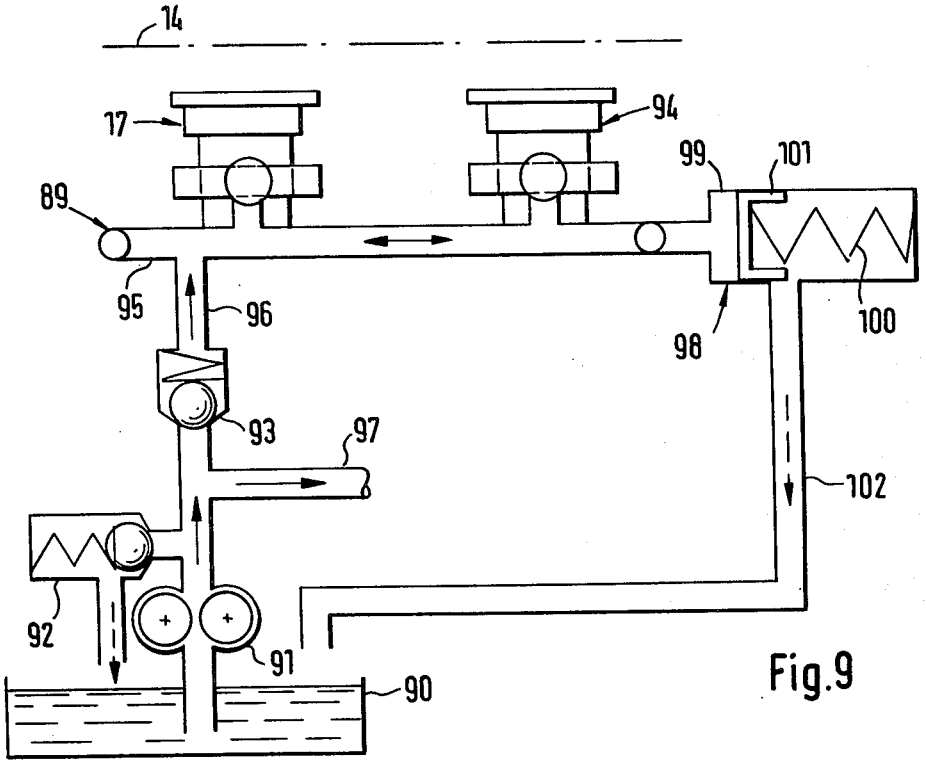
FIG. 9 represents schematically the oil supply system of the hydraulic arrangement.
Figure 10:
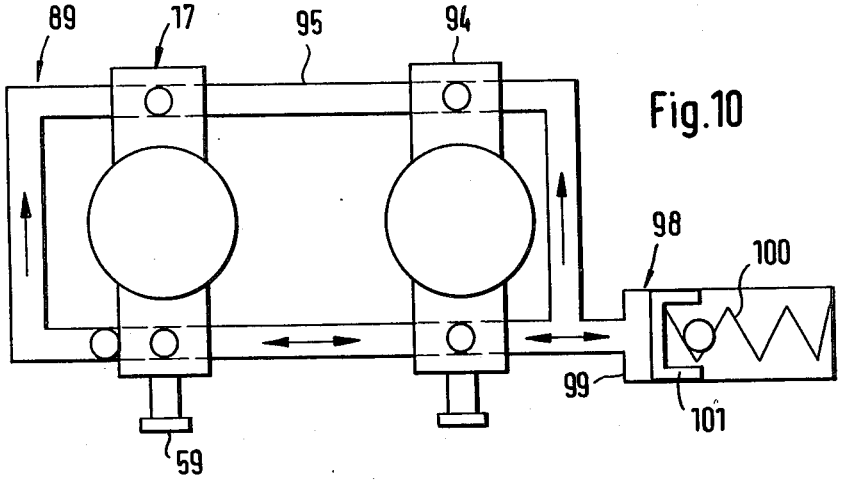
FIG. 10 is a plan view of FIG. 9.

The orifice 63 provided in the arm 25 of housing 18 and an orifice 88 in arm 26, which is connected to transverse boring 44 (FIG. 2), are connected to a schematically represented oil supply system (FIGS. 9 and 10). The oil supply system 89 comprises an oil sump 90, an oil pump 91, an oil pressure regulating valve 92, and a check valve 93. Hydraulic arrangement 17 for valve 7 (inlet valve) and another hydraulic arrangement 94 which cooperates with an outlet valve (not shown) (single cylinder motor), are connected to a loop line 95 by said orifices 63 and 88. Loop line 95 is connected to a feed line 96 in which the check valve 93, oil pressure regulating valve 92, and oil pump 91 are mounted. A supply line 97 for the engine, e.g. for the crank drive, is indicated between the oil pump and check valve 93 which blocks flow in the direction opposite the inflow direction.

Loop line 95 is connected to a pressure accumulator 98 connected to the pressure chamber 29 of power piston 20.

Pressure accumulator 98 includes a cylinder 99 and a piston 101 loaded by a spring 100 and contained in said cylinder. When the system pressure is normal, piston 101 blocks a line 102 extending to oil sump 90. When the system pressure is too high, piston 101 is moved against the force of spring 99 and hydraulic pressure medium escapes through line 102, which prevents the occurrence of pressure peaks in the pressure system of hydraulic arrangement 17. With reference to FIGS. 11*a–e* (full load) and 12*a–e* (partial load), it can be seen that the valve control operates as follows:

In the full load range VL, setting cam 66 moves to position E (FIG. 11), and throttle element 59 closes transverse boring 44. The adjustment occurs in response to load and/or rpm (FIGS. 4–7). In this operating condition, valve 7 has a maximum stroke and a maximum opening time.

Figure 11A:
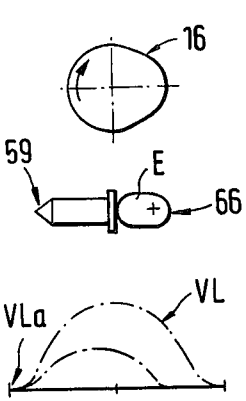
FIGS. 11*a*–11*e* are explanatory diagrams of the valve control.

In diagram of FIG. 11*a*, cam 16 has initially no effect on valve 7 or on the valve stroke curve VLa. In the FIG. 11*b* diagram, cam 16 moves power piston 22 downward resulting in the hydraulic medium being displaced in pressure chamber 29. Since check valve 44' in boring 44 and throttle element 59 (leakage losses are negligible) prevent medium backflow a hydraulic transmission is initiated in piston system 19 that causes drive piston 22 to be moved downward and hydraulic medium flows through piston valve 21 into the space between drive piston 22 (bore 37). Drive piston 22 and actuating piston 23 are forced apart by spring 38 since said spring generates a differential force. The equal area surfaces of drive piston 22 and actuating piston 23 determine equal hydraulic forces on the two piston surfaces.

Figure 11B:
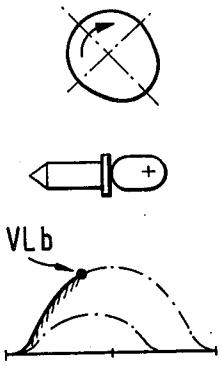

Consequently, the motion of actuating piston 23 is transmitted to valve 7. In the diagram of FIG. 11*b* the stroke curve has reached position VLb.

During this stroke, piston valve 57 and the small piston surface in arrangement 52 prevent the outflow of hydraulic medium.

Figure 11C:
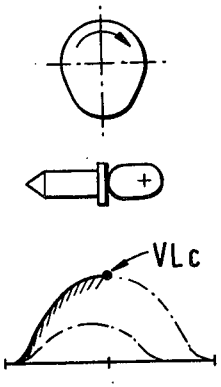

In the diagram of FIG. 11*c*, cam 16 has reached its maximum valve lift position. Consequently, the strokes of actuating piston 23 and valve 7 are maximum. The valve stroke curve ends at VLc. During this time drive piston 22 has been forced upward again and is in contact with stop 35.

Figure 11D:
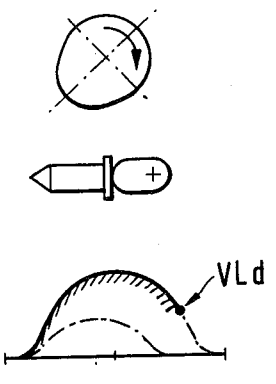

In FIG. 11*d*, cam 16 has left the maximum valve lift position, so that power piston 20, actuating piston 23, and valve 7 move upward again. The position of valve 7 is indicated at VLd in the stroke curve. The hydraulic medium present between drive piston 22 and actuating piston 23 is forced back into pressure chamber 29 through recess 39.

When the surface 41 of actuating piston 23 reaches control edge 46 (FIG. 3) the motion of actuating piston 23 and therefore also of valve 7 are delayed by damping means 45. The free sectional surface area between control edge 46 and actuating piston 23, available for the displacement of the medium, is reduced by bevel edge system 47, especially by the bevel edge 49 thereof. The damping means acts as a hydraulic seating damping means for valve 7.

Figure 11E:
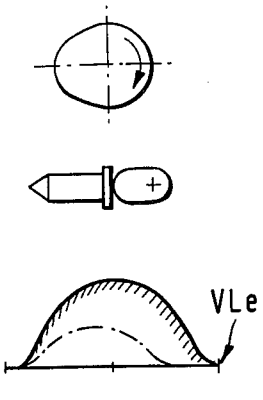

FIG. 11*e* shows cam 16 in the position which it assumes at the end of the stroke, indicated by VLe.

During the inactive phase of valve 7 the leakage oil is compensated for through orifice 88 until the next valve stroke begins.

In the described stroke operation with closed throttle element 59 (position E) the stroke and opening time of valve 7 depend on the hydraulic transmission of piston system 19 and on the shape of cam 16. For this purpose different surfaces are provided on power piston 20 and drive piston 22 or actuating piston 23.

In the partial load range TL (FIGS. 12*a–e*) setting cam 66 is pivoted to position F (in response to load and/or rpm). Throttle element 59 is now open. In the diagram of FIG. 11*a*, the valve is positioned as indicated at TLa' in the valve curve.

Figure 12A:
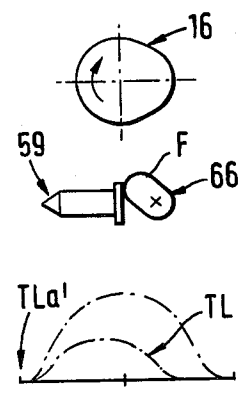
FIGS. 12*a*–12*e* are views corresponding to FIGS. 11*a*–11*e* for partial load.
Figure 12B:
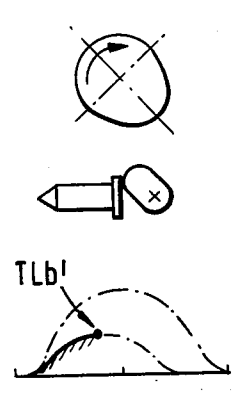
Figure 12C:
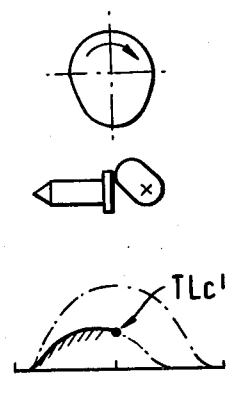

In FIG. 12*b*, power piston 20 is actuated again by cam 16. The displaced medium again actuates drive piston 22, actuating piston 23, and valve 7, but a fraction of the medium escapes through open throttle element 59. Consequently, the stroke and opening time of valve 7 are reduced. The valve curve is flatter, and then the valve reaches the position TLb' in the valve stroke curve.

Figure 12D:
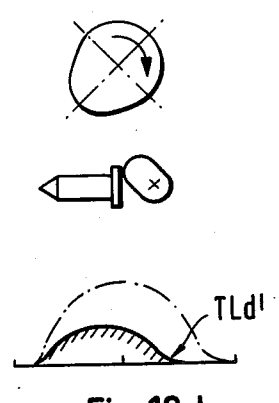
Figure 12E:
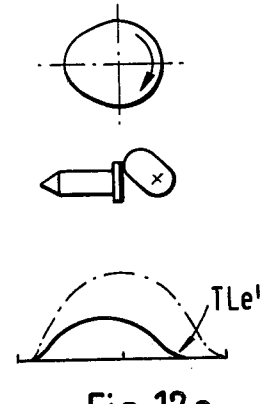

The maximum lift position of cam 16 is indicated in FIG. 12*e*. It is apparent that the maximum stroke of valve 7 has been passed (i.e., position TLc' is beyond the peak in the stroke curve). This results from the small amount of medium present in piston system 19.

In the diagram of FIG. 12*d*, valve 7 has closed already—the stroke curve ends at TLd'—although it would still be open for this cam position at VLd. Damping means 45 determines exactly when valve 7 leads cam 16 the damped seating of valve 7.

The end TLd' of the stroke curve in FIG. 12*e* corresponds to the condition shown in FIG. 12*d*.

The medium displaced during the stroke flows again through loop line 95 or supply system 89 during the inactive phase of valve 7.

The medium forced out through throttle element 59 is prevented by check valve 93 from penetrating the general medium supply system of the internal combustion engine, so that pressure variations in said system are excluded.

The separate pressure systems of hydraulic arrangements 17 and 94 are connected to pressure accumulator 98 which absorbs the expressed medium during the valve stroke, and therefore prevents disturbances in the pressure system. The accumulated medium is used also to rapidly refill hydraulic arrangements 17 and 94 during the inactive phase of the valve.

When the pressure is too high piston 101 is forced back against the force of spring 100, and oil can flow out into oil sump 90 through line 102.

While the preceding description of the valve operation has made reference to hydraulic arrangement 17 (and like companion arrangement 94), it should be apparent how same also applies to use of the modified arrangement 78 of FIG. 8.

While I have shown and described various embodiments in accordance with the present invention, it is understood that the same is not limited thereto but is susceptible of numerous changes and modifications as shown to those skilled in the art and I therefore do not wish to be limited to the details shown and described herein but intend to cover all such changes and modifications as are encompassed by the scope of the appended claims.

We claim:

1. A valve control for an internal combustion engine, comprising a hydraulic arrangement between a camshaft and a cylinder head valve of the engine for controlling stroke length and opening time of the valve, said hydraulic arrangement including a multiple piston system having first piston means for cooperating with the camshaft, second piston means for cooperating with at least one of said first piston means and a third piston means, and third piston means for cooperating with said valve, housing means within which at least the third piston means of said piston system is disposed, and damping means for controlling seating of the valve, adjustable means associated with said piston system including throttle means for influencing the piston system wherein said throttle means is adjustably controlled by at least one operating parameter of the internal combustion engine, and wherein the stroke length and opening time of the valve may be varied by the piston system of said hydraulic arrangement being influenced by adjustment of said throttle means in response to changes in said at least one operating parameter of said internal combustion engine.

2. The valve control according to claim 1, wherein said damping means is provided between said housing and said third piston means.

3. The valve control according to claim 2, wherein, in the closed position of the cylinder head valve, a stepped extension of the third piston means penetrates a recess in the housing; and a bevel edge system constituting the damping means is provided between the extension and the recess.

4. The valve control according to claim 3, wherein the bevel edge system is provided on the third piston means.

5. The valve control according to claim 3, wherein the bevel edge system is provided on the third piston means and a recess in the housing.

6. The valve control according to claim 1, wherein said second piston means includes a piston valve therein;

said first piston means, in cooperation with the camshaft, acts on said second piston means and said third piston means to control the stroke of the cylinder head valve through the damping means.

7. The valve control according to claim 6, wherein an arrangement for automatic valve play compensation is integrated in the third piston means.

8. The valve control accoding to claim 6, wherein a pressure chamber in the first piston means is connected to a pressure accumulator by a loop line.

9. The valve control according to claim 6, wherein the throttle means is mounted in a bore within the housing, said bore being connected to a pressure chamber in the first piston means.

10. The valve control according to claim 9, wherein a check valve is provided in second bore located in said housing.

11. The valve control according to claim 6, wherein a pressure chamber in the first piston means is connected to a pressure accumulator by a loop line.

12. The valve control according to claim 11, wherein the pressure accumulator includes a cylinder and a spring loaded piston.

13. The valve control according to claim 11, wherein the spring loaded piston is operable for opening a pressure medium outflow line on occurrence of pressure peaks.

14. The valve control according to claim 6, wherein the damping means comprises a control edge of the housing and a bevel system located at an upper end of the third piston means.

15. The valve control according to claim 14, wherein the bevel edge system comprises a first bevel edge at an angle $\alpha$ relative to a vertical line and a second bevel edge at an angle $\beta$ relative to a horizontal line.

16. The valve control according to claim 15, wherein angle $\alpha$ is in the range of 1°–10°.

17. The valve control according to claim 15, wherein angle $\beta$ is in the range of 10°–70°.

18. The valve control according to claim 6, wherein said arrangement includes a stop for positioning said second piston means when said valve is in the closed position, said second piston means being held in position on one side by the third piston means and on another side by said stop.

19. The valve control according to claim 18, wherein the second piston means includes a shoulder which cooperates with the stop.

20. The valve control according to claim 6 or 18, wherein the second piston means is provided with a bore which houses a compression spring abutting against the third piston means.

21. The valve control according to claim 20, wherein a piston valve is located inside the bore.

22. The valve control according to claim 1, wherein the first piston means extends around a cylindrical sleeve of the housing.

23. The valve control according to claim 22, wherein said second piston means is located between said first piston means and said third piston means and said piston valve is operable to communicate fluid from a pressure chamber in the first piston means through said second piston means to said third piston means.

24. The valve control according to claim 22, wherein an upper end of the first piston means is provided with a collar abutting a compression spring.

25. The valve control according to claim 6 or 24, wherein the throttle means is actuated by a setting cam.

26. The valve control according to claim 25, wherein the setting cam is actuated in response to engine load by a pressure responsive device connected to a suction line.

27. The valve control according to claim 25, wherein the setting cam is actuated in response to engine load by a choke valve.

28. The valve control according to claim 25, wherein the setting cam is actuated in response to engine rpm by a centrifugal governor.

29. The valve control according to claim 25, wherein the setting cam is actuated in response to engine rpm and load by a centrifugal governor and a pressure responsive device connected to a suction line.

* * * * *